US011464711B2

(12) United States Patent
Provencher et al.

(10) Patent No.: US 11,464,711 B2
(45) Date of Patent: Oct. 11, 2022

(54) MEDICATION DISPENSING APPARATUS

(71) Applicant: CERNER INNOVATION, INC., Kansas City, KS (US)

(72) Inventors: Ryan Provencher, Downingtown, PA (US); Aashiq Boga, Malvern, PA (US); Dhruv Maneklal Gala, Malvern, PA (US); Mahamadou Koné, Bala Cynwyd, PA (US); Sachindranath Toutom, Downingtown, PA (US)

(73) Assignee: CERNER INNOVATION, INC., North Kansas City, MO (US)

( * ) Notice: Subject to any disclaimer, the term of this patent is extended or adjusted under 35 U.S.C. 154(b) by 0 days.

(21) Appl. No.: 16/717,267

(22) Filed: Dec. 17, 2019

(65) Prior Publication Data

US 2020/0206087 A1 Jul. 2, 2020

Related U.S. Application Data

(60) Provisional application No. 62/784,999, filed on Dec. 26, 2018.

(51) Int. Cl.

| | |
|---|---|
| ***A61J 7/04*** | (2006.01) |
| ***A61J 7/00*** | (2006.01) |
| ***G07F 17/00*** | (2006.01) |

(52) U.S. Cl.

CPC ..... *A61J 7/0481* (2013.01); *A61J 7/0076* (2013.01); *A61J 7/0418* (2015.05); *A61J 7/0436* (2015.05); *G07F 17/0092* (2013.01); *A61J 2200/30* (2013.01); *A61J 2200/70* (2013.01)

(58) Field of Classification Search

None

See application file for complete search history.

(56) References Cited

U.S. PATENT DOCUMENTS

| | | | | |
|---|---|---|---|---|
| 8,727,180 | B2 * | 5/2014 | Zonana | B65D 83/0409 221/241 |
| 2013/0116818 | A1 * | 5/2013 | Hamilton | A61J 7/04 700/236 |
| 2016/0042150 | A1 * | 2/2016 | Moloughney | G16H 20/13 700/237 |

* cited by examiner

*Primary Examiner* — Gene O Crawford
*Assistant Examiner* — Ayodeji T Ojofeitimi
(74) *Attorney, Agent, or Firm* — Shook, Hardy and Bacon L.L.P.

(57) ABSTRACT

A medication dispensing apparatus is provided herein along with computer-useable instructions embodied on a microcontroller for control of said medication dispensing apparatus. Instructions may be embodied on the microcontroller to control a dosing of medication via a coupled motor. The microcontroller controls rotation of the motor to line up a cavity with a dispensing port such that medication from a medication container (e.g., pill bottle) is dispensed via the dispensing apparatus.

20 Claims, 10 Drawing Sheets

MEDICATION DISPENSING APPARATUS

CROSS-REFERENCE TO RELATED APPLICATIONS

This application claims the benefit of priority to U.S. Provisional Application No. 62/784,999, filed on Dec. 26, 2018, entitled "Medication Dispensing Apparatus," the entirety of which is incorporated herein by reference.

FIELD

Aspects provided relate to a medication dispensing apparatus.

BACKGROUND

Administration of medication has long relied upon a recipient's and/or a recipient caregiver's memory. As a result, human error has caused incorrect doses of medication to be administered and/or administration of the medication at incorrect time intervals. Some attempts to address these problems have included labels and pill containers.

Labels containing dosing instructions and administration schedules have been applied to medication containers. Labels only contain written instructions and therefore still rely upon the recipient's and/or recipient caregiver's memory to recall the timing for each subsequent dose. Further, some recipients and/or recipient caregivers are blind and/or have difficulty reading the labels applied to medication containers. Others are simply forgetful.

Pill containers having a plurality of separate chambers have been used to segment the medication into separate doses. Each of the separate chambers may have a lid and each lid may be labeled (e.g., with a day of the week). Unfortunately, pill containers usually do not have enough chambers to segment the entire medication container into separate doses. Thus, pill containers must be refilled (e.g., every week). Further, pill containers still rely upon the recipient's and/or recipient caregiver's memory to recall the timing for each subsequent dose.

SUMMARY

At a high level, aspects herein are directed to a medication dispensing apparatus that may be configured to dispense specified doses at specified time intervals and may be further configured to provide an audible signal, a visual signal, or both once the specified time interval has elapsed. The medication dispensing apparatus may include a dispensing cap coupled to a medication container. The dispensing cap may include an input port permitting communication of medication from the medication container to the dispensing cap, a dispensing disc configured to segment the received medication into doses, a motor for actuating the dispensing disc, and a dispensing port for communicating the doses of medication out of the medication dispensing apparatus. The motor may be controlled with a control unit (e.g., a microcontroller) electrically coupled thereto. At least one of a light system for providing a visual signal and a sound system for providing the audible signal may be coupled to the control unit. The light system may include a light (e.g., a LED) and the sound system may include a speaker. In some aspects, the dispensing cap may include one or more input buttons. A lid may be coupled to the dispensing cap for reversibly closing the dispensing port. A screen may be positioned between the dispensing disc and the received medication to limit the quantity of medication communicated to the dispensing disc.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

DETAILED DESCRIPTION

Figure 1:
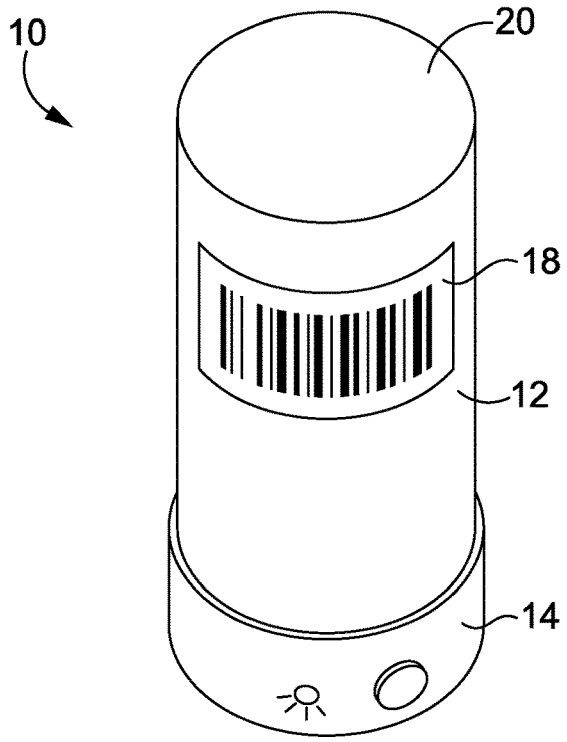
FIG. 1 depicts a perspective view of a medication dispensing apparatus, in accordance with aspects hereof.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

As one skilled in the art will appreciate, embodiments of the invention may be embodied as, among other things: a method, system, apparatus, or set of instructions embodied on one or more computer readable media. Accordingly, the embodiments may take the form of a hardware embodiment, a software embodiment, or an embodiment combining software and hardware. In one embodiment, the invention takes the form of a computer-program product that includes computer-usable instructions embodied on one or more computer readable media. In another embodiment, the invention takes the form of a medication dispensing apparatus that includes a computer-program product that comprises computer-usable instructions embodied on one or more computer readable media.

At a high level, aspects herein are directed to a medication dispensing apparatus that may be configured to dispense specified doses at specified time intervals and may be further configured to provide an audible signal, a visual signal, or both once the specified time interval has elapsed. The medication dispensing apparatus may include a dispensing cap coupled to a medication container. The dispensing cap may include an input port permitting delivery of a medication from the medication container to the dispensing cap, a dispensing disc configured to segment the received medication into doses, a motor for actuating the dispensing disc, and a dispensing port for communicating the doses of medication out of the medication dispensing apparatus. The motor may be controlled with a control unit (e.g., a microcontroller) electrically coupled thereto. At least one of a light system for providing a visual signal and a sound system for providing the audible signal may be coupled to the control unit. The light system may include a light (e.g., a LED) and the sound system may include a speaker. In some aspects, the dispensing cap may include one or more input buttons. A lid may be coupled to the dispensing cap for reversibly closing the dispensing port. A screen may be positioned between the dispensing disc and the received medication to limit the quantity of medication communicated to the dispensing disc.

Aspects hereof may be described using relative location terminology. For example, the term "proximate" is intended to mean on, about, near, by, next to, at, and the like. The term "about" when used in relation to measurements means within ±10% of a designated value. Therefore, when a feature is proximate another feature, it is close in proximity but not necessarily exactly at the described location, in some aspects. Additionally, the term "distal" refers to a portion of a feature herein that is positioned away from a midpoint of the feature. Terms such as "attached," "secured," "affixed," and the like may mean elements that are releasably attached to one another using, for example, snap systems, slider systems, hook-and-loop closure systems, releasable adhesives, buttons, hooks, and the like. These terms may further mean elements that are permanently attached to one another using, for example, stitching, bonding, welding, and the like.

The term "releasable fastener" as used herein refers to a fastener system that can be repeatedly coupled and uncoupled to respectively secure or disengage components from each other. An example releasable fastener may comprise, buttons, snaps, hook-and-loop fasteners, slider systems including zippers, and the like. In line with this, the term "complementary" when describing components of a releasable fastener system means components having structures that mechanically engage with each other.

Figure 2A:
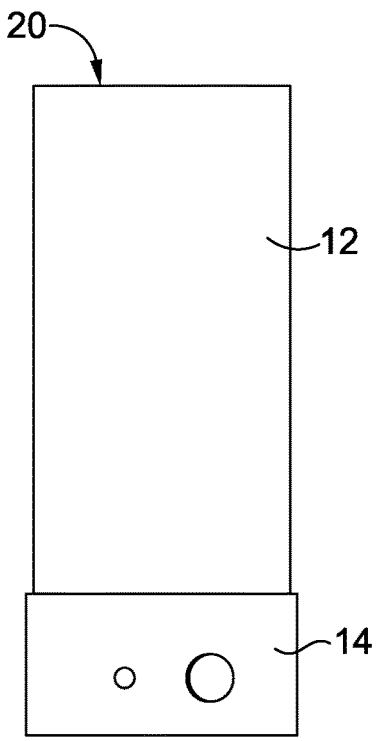
FIG. 2A depicts an elevation view of the medication dispensing apparatus of FIG. 1, in accordance with aspects hereof.
Figure 2B:
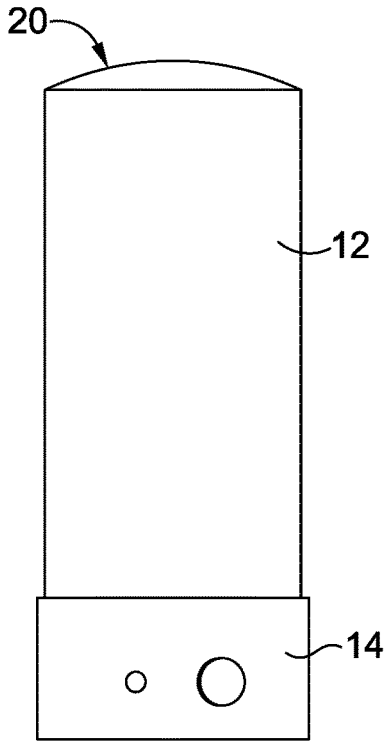
FIG. 2B depicts an elevation view of another aspect of a medication dispensing apparatus, in accordance with aspects hereof.

Turning now to FIG. 1, a medication dispensing apparatus 10 may include a medication container 12 detachably coupled to a dispensing cap 14. When medication is to be administered, the medication may be added the medication container 12. The medication container 12 may include a mouth 216 for communicating the medication. The medication container 12 may include a releasable fastener, or a portion thereof. For example, an exterior portion of the medication container 12 may be threaded proximate the mouth 216. In some aspects, the medication container 12 may include a threaded male portion configured to releasably couple to a female portion of the dispensing cap 14. In other aspects, the medication container 12 may be a prescription bottle, an over-the-counter medication bottle, or another container. The medication container 12 may include a label 18 (e.g., a barcode, a QR code, etc.) that indicates the type of medication, the prescribed dosage of medication, and/or the prescribed administration instructions (e.g., time interval, etc.). The medication container 12 may include a top 20. As best seen in FIGS. 2A and 2B, the top 20 may be flat or may be domed. A domed top 20 may prevent the medication dispensing apparatus 10 from being set upside down.

Figure 3:
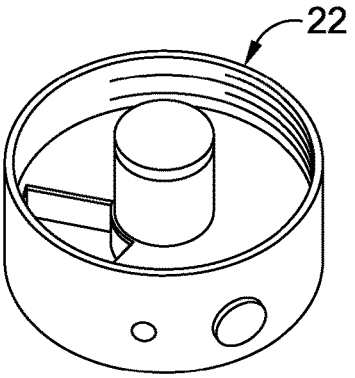
FIG. 3 depicts a top perspective view of a dispensing cap of the medication dispensing apparatus of FIG. 1, in accordance with aspects hereof.
Figure 4:
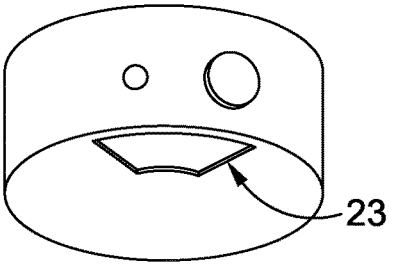
FIG. 4 depicts a bottom perspective view of the dispensing cap of the medication dispensing apparatus of FIG. 1, in accordance with aspects hereof.
Figure 5:
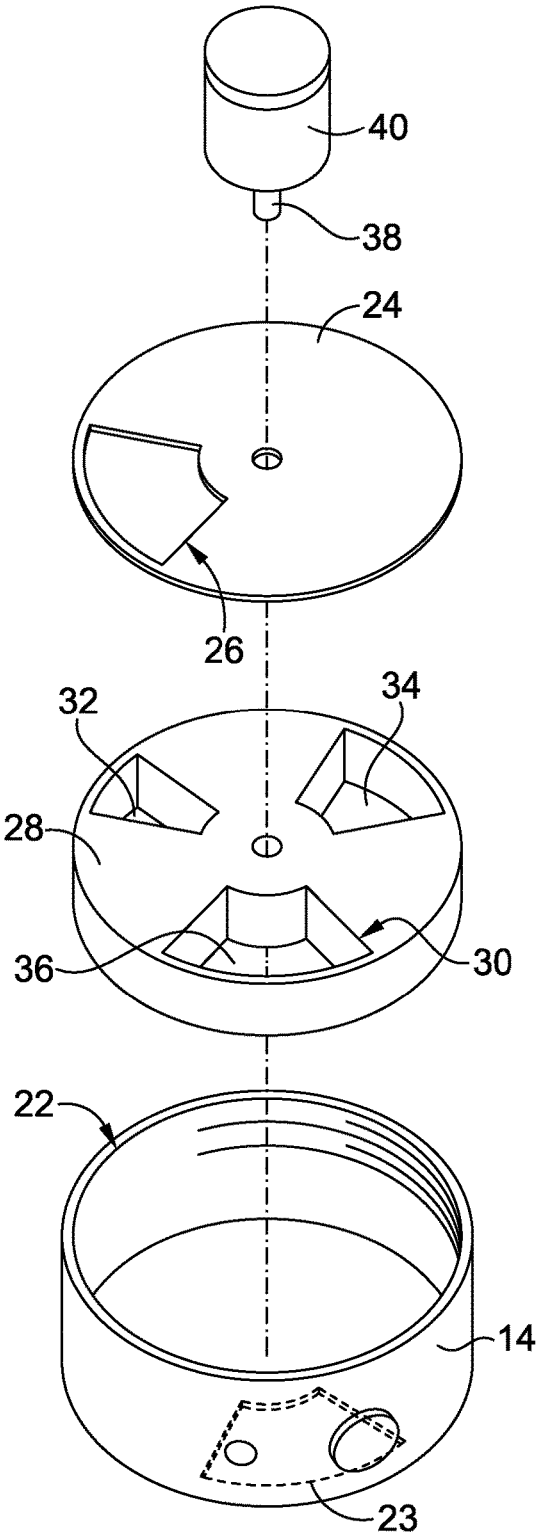
FIG. 5 depicts an exploded view of dispensing cap of FIG. 3, in accordance with aspects hereof.

Referring to FIGS. 3-5, the dispensing cap 14 may include an input port 22 and a dispensing port 23. The input port 22 may be configured to releasably couple to the medication container 12. In other aspects, other types of releasable coupling may be used to temporarily couple the medication container 12 to the dispensing cap 14. For example, releasable fasteners may affix the medication container 12 to the dispensing cap 14. After the medication container 12 is coupled to the dispensing cap 14, medication may be communicated through the input port 22.

Received medication may be separated into doses inside the dispensing cap 14 by a screen 24 having a screen port 26. The screen 24 may be affixed to an interior wall of the dispensing cap 14, in accordance with some aspects. The screen port 26 has a smaller area than the input port 22. In some aspects, the screen port 26 may be sized for a specific medication size (e.g., 100 mg, 350 mg, etc.) and/or may be shaped to accommodate a specific medication shape (e.g., round, elongate, rectangular, etc.). In other aspects, the screen 24 may be releasably coupled to the dispensing cap 14. In these aspects, the screen 24 may be one of a plurality of screens that each include a different size and/or shape screen port 26. The screen 24 may only permit a single dose of medication to pass through the screen port 26. For example, only one pill may fit through the screen port 26.

On the other side of the screen 24 is a dispensing disc 28. The dispensing disc 28 may include one or more cavities 30. Each of the one or more cavities 30 may be the same size and shape, or may vary in size and/or shape from one another. The one or more cavities may comprise passages that extend from a first side of the dispensing disc 28 to an opposite, second side of the dispensing disc 28. In some aspects, the one or more cavities may be formed interior to a perimeter of the dispensing disc 28. In the illustrated aspect shown in FIG. 5, the dispensing disc 28 includes a first cavity 32, a second cavity 34, and a third cavity 36. The first cavity 32 is smaller than the second cavity 34, and the second cavity 34 is smaller than the third cavity 36. These relative sizes permit different doses of medication to be received by the dispensing disc 28. For example, the third cavity 36 may be used for larger sized medications, such as large pills, and/or for larger sized doses of medication, such as a large quantity of pills. In some aspects, the dispensing disc 28 may be shaped as a cog such that the one or more cavities 30 are positioned on the edge of the dispensing disc 28 and are not bounded on all sides.

The dispensing disc 28 is coupled to an output shaft 38 of a motor 40. As discussed herein, the motor 40 is configured to turn the dispensing disc 28 such that one of the one or more cavities 30 is aligned with the screen port 26 to receive a dose of the medication. After the medication is received, the motor 40 is further configured to turn the dispensing disc 28 such that the one of the one or more cavities 30 is aligned with the dispensing port 23. In some aspects, the screen 24 may not be coupled to the dispensing cap and instead may be coupled to the output shaft 38 of the motor 40. In these aspects, the screen 24 does not rotate the output shaft 38 turns.

Figure 10A:
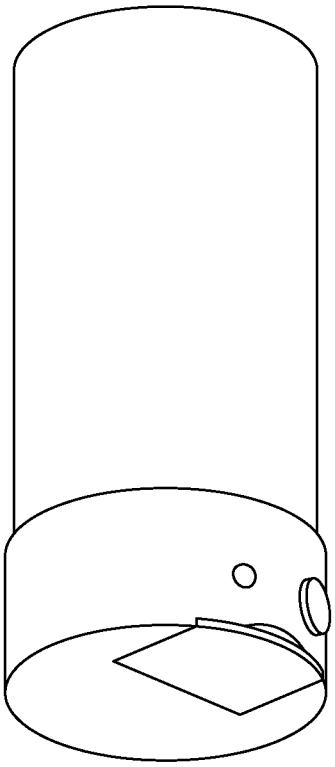
FIG. 10A depicts a perspective view of a medication dispensing apparatus with a lid in a closed configuration, in accordance with aspects hereof.
Figure 10B:
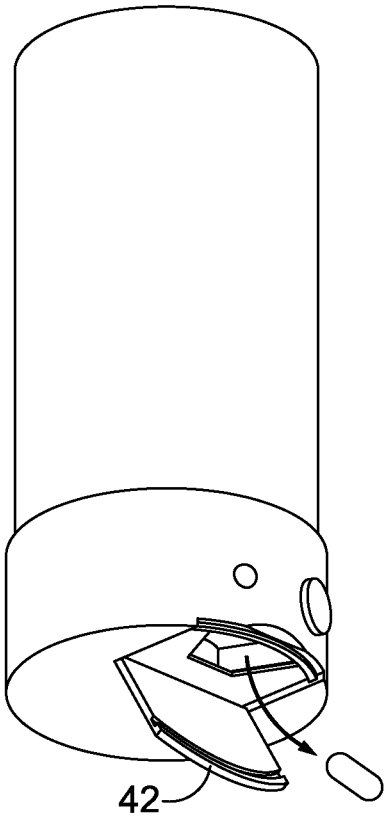
FIG. 10B depicts a perspective view of the medication dispensing apparatus of FIG. 10A with the lid in an open configuration, in accordance with aspects hereof.

The dispensing port 23 may comprise a passage through the dispensing cap 14. In some aspects, the dispensing port 23 may include a lid 42 (best seen in FIGS. 10A and 10B). The lid 42 may be releasably fastened to the dispensing cap 14 or partially affixed to the dispensing cap 14 (e.g., hinged).

Turning to FIGS. 6A-6D, one aspect of a dispensing operation is illustrated. Portions of the medication dispensing apparatus 10 have been removed in these figures to aid explanation. The medication container 12 is coupled to the dispensing cap 14 and one or more pills 44 are contained therein. In this aspect, each dose comprises a single pill 44. As discussed herein, however, in other aspects any number or size or type of medication may comprise a dose.

Figure 6A:
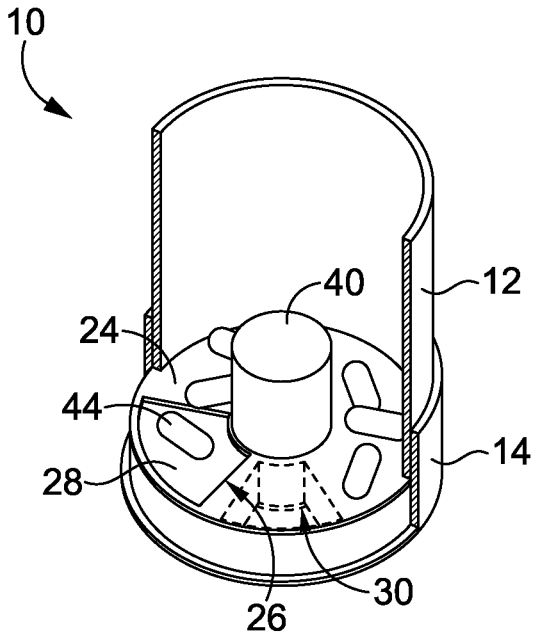
FIG. 6A depicts a detail perspective view of the medication dispensing apparatus of FIG. 1 in a first position, in accordance with aspects hereof.

In FIG. 6A, a first condition of the medication dispensing apparatus 10 is illustrated. The first condition occurs during the time period after a prior dose has been dispensed from the dispensing cap 14 and prior to the time a next dose of medication is to be dispensed. In the first condition, the one or more cavities 30 of the dispensing disc 28 are not aligned with the screen port 26. For example, no part of the screen port 26 overlaps any portion of the one or more cavities 30, in accordance with some aspects. As a result, the one or more pills 44 are not permitted to enter any of the one or more cavities 30 and are consequently held above the screen 24 and/or the dispensing disc 28.

Figure 6B:
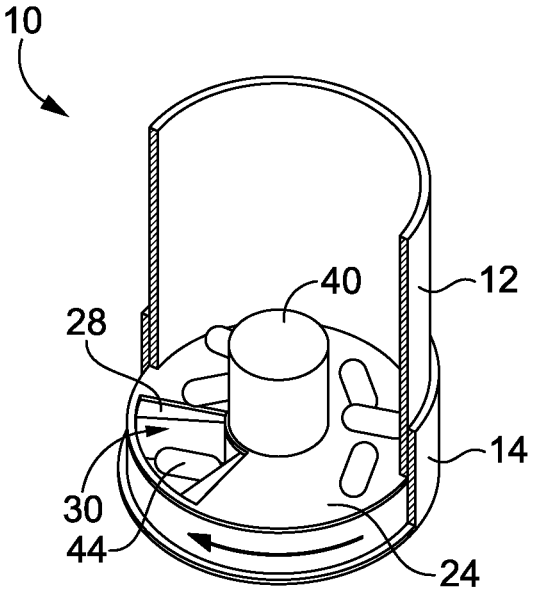
FIG. 6B depicts a detail perspective view of the medication dispensing apparatus of FIG. 1 in a second position, in accordance with aspects hereof.

In FIG. 6B, a second condition of the medication dispensing apparatus 10 is illustrated. The second condition occurs at the time when the next dose of medication is to be dispensed but before a pill 44 has been received within a cavity 30 of the dispensing disc 28. In the second condition, the motor 40 moves the dispensing disc 28 relative to the screen 24 until one of the one or more cavities 30 is aligned with the screen port 26 and/or one of the one or more pills 44 has been received within said cavity of the one or more cavities 30. Although the illustrated pill 44, screen port 26, and cavity 30 appear to be sized such that multiple pills may be communicated during the second condition, it is anticipated that some aspects may have a screen port 26 more closely sized to match the size of the dispensed medication. It is also anticipated that in other aspects, only a portion of the cavity large enough to receive the dispensed medication need be aligned with the screen port (i.e., only partially overlap the screen port). In order to prevent and or address blockages of the medication, some aspects may include a sweep arm (not shown) driven by the motor 40. The sweep arm may facilitate reorientation of the medication when a blockage occurs to allow the dose to be communicated into the cavity 30.

Figure 6C:
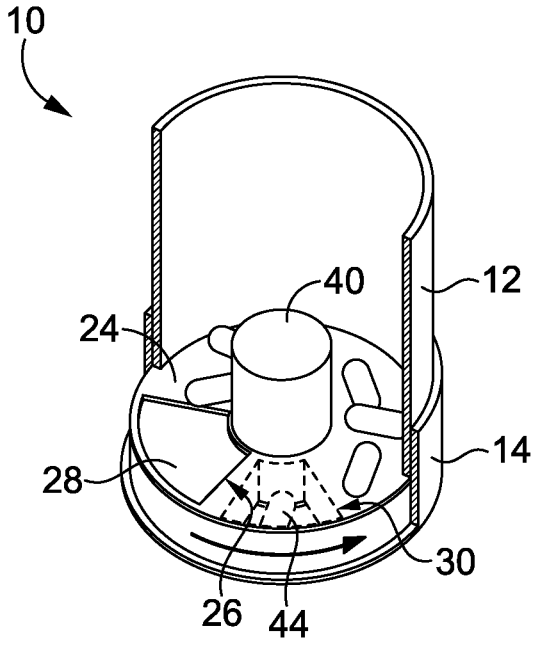
FIG. 6C depicts a detail perspective view of the medication dispensing apparatus of FIG. 1 in a third position, in accordance with aspects hereof.
Figure 6D:
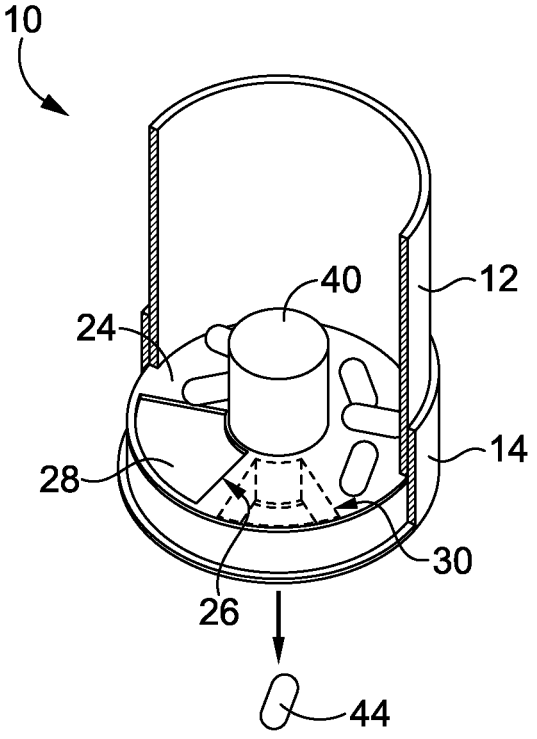
FIG. 6D depicts a detail perspective view of the medication dispensing apparatus of FIG. 1 dispensing a medication, in accordance with aspects hereof.
Figure 7A:
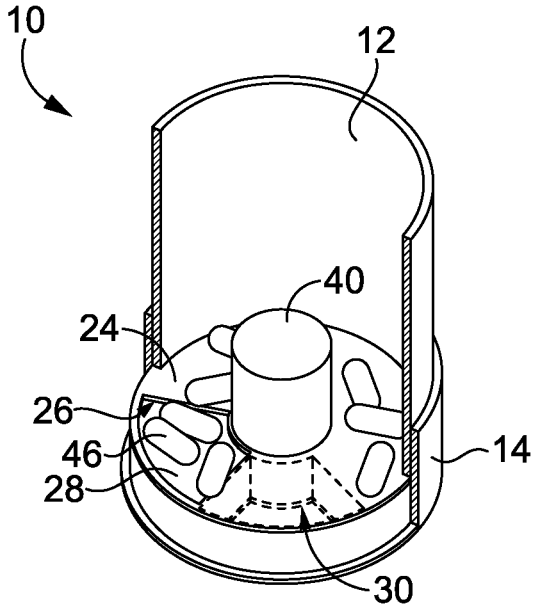
FIG. 7A depicts a detail perspective view of the medication dispensing apparatus of FIG. 1 in a first position, in accordance with aspects hereof.
Figure 7B:
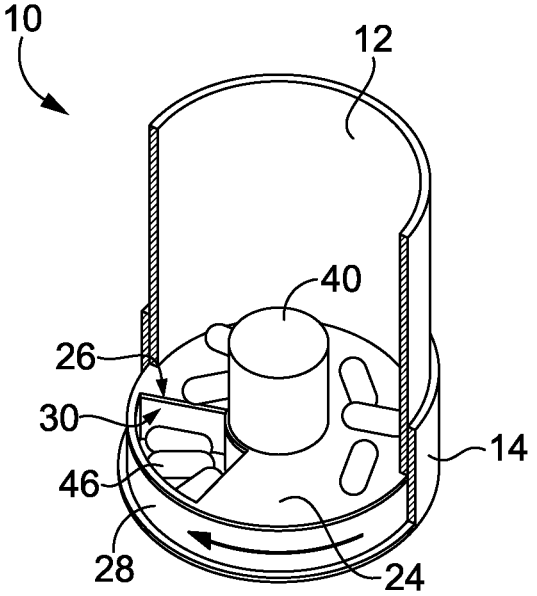
FIG. 7B depicts a detail perspective view of the medication dispensing apparatus of FIG. 1 in a second position, in accordance with aspects hereof.
Figure 7C:
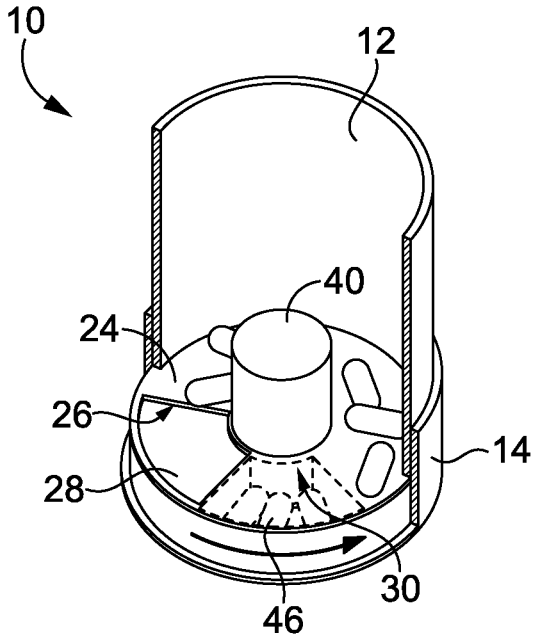
FIG. 7C depicts a detail perspective view of the medication dispensing apparatus of FIG. 1 in a third position, in accordance with aspects hereof.
Figure 7D:
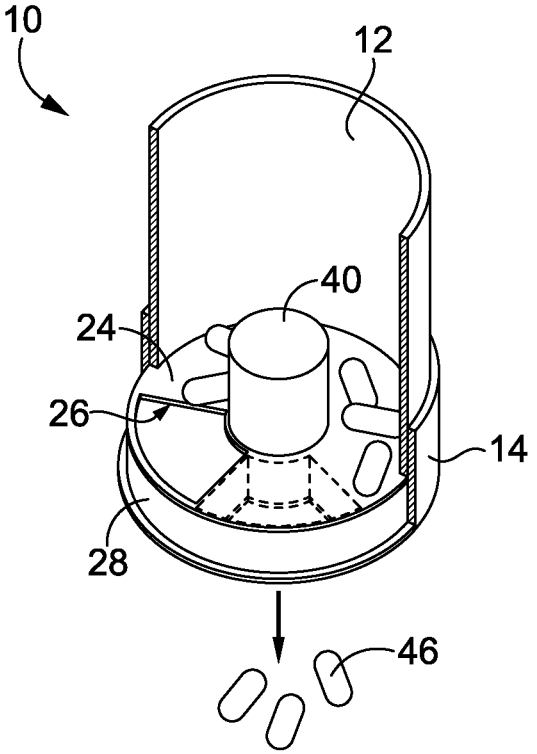
FIG. 7D depicts a detail perspective view of the medication dispensing apparatus of FIG. 1 dispensing a medication, in accordance with aspects hereof.

In FIG. 6C, a third condition of the medication dispensing apparatus 10 is illustrated. The third condition occurs after a pill 44 has been received within a cavity 30 of the dispensing disc 28 but before the pill 44 has been dispensed from the dispensing cap 14. In the third condition, the motor 40 moves the dispensing disc 28 and the pill 44 received within the cavity 30 relative to the screen 24 until the cavity 30 is aligned with the dispensing port 23. In aspects where the dispensing cap 14 does not have a lid that prevents communication of the pill 44 out of the dispensing port 23, the pill 44 is communicated (e.g., falls) out of the dispensing cap 14 for administration to the patient. This aspect is illustrated in FIG. 6D.

A similar aspect of a medication dispensing operation is illustrated in FIGS. 7A-7D to that shown in FIGS. 6A-6D. In this aspect, however, the dose includes a plurality of individual medication packages 46 (e.g., three pills). In all other respects, the medication dispensing operation shown in FIGS. 7A-7D may be similar to that shown in FIGS. 6A-6D.

In the above-described aspects, the medication is stored in the medication container and/or above the screen and dispensing disc. In other aspects, however, one or more doses of medication may be stored in the one or more cavities of the dispensing disc. In these aspects, the motor need merely rotate the dispensing disc to a position in alignment with the dispensing port.

Figure 8:
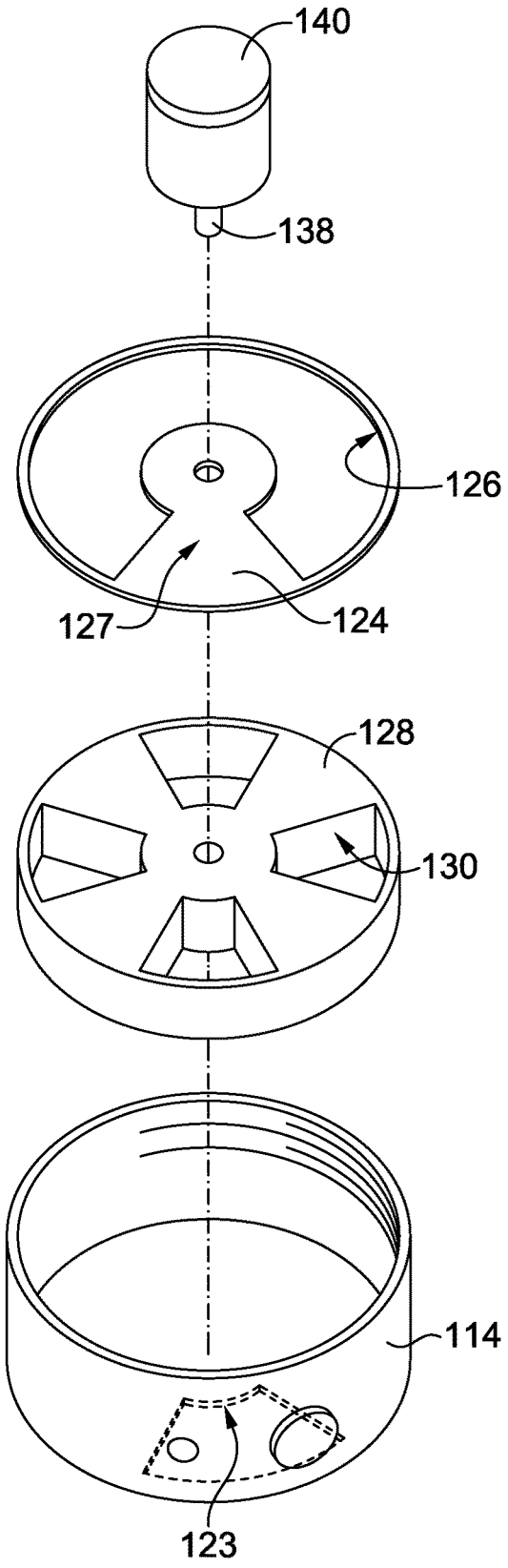
FIG. 8 depicts an exploded view of another aspect of a medication dispensing cap, in accordance with aspects hereof.

For example, in the aspect illustrated in FIG. 8, a dispensing cap 114 may include many of the same features discussed in reference to the dispensing cap 14. The dispensing cap 114, however, may have a screen 124 with a screen port 126 that is much larger than the screen port 26.

The screen port 126 includes a first surface 127. The first surface 127 is positioned in alignment with a dispensing port 123. Thus, in this aspect, the screen port 126 doesn't restrain medication from entering the one or more cavities 130 generally. Rather, the first surface 127 restrains medication from entering any of the one or more cavities 130 aligned with the dispensing port 123. Doses are seated in the remaining one or more cavities 130. When a motor 140 rotates the dispensing disc 128 such that one of the one or more cavities 130 having medication seated therein in alignment with the dispensing port 123, said medication is dispensed. In this aspect, the screen 124 functions more akin to a scraper by removing excess medication from the one or more cavities 130 rather than a filter that limits access to same.

FIGS. 9A-9E illustrate an aspect of a medication dispensing operation using a medication dispensing apparatus 110. Portions of the medication dispensing apparatus 110 have been removed to simplify this discussion. The medication dispensing apparatus 110 is shown having a medication container 112 coupled to the medication dispensing cap 114. The dispensing disc 128 includes a first cavity 150, containing a first pill 152, a second cavity 154, containing a second pill 156. The dispensing disc 128 may include one or more additional cavities 130 and may contain one or more pills.

Figure 9C:
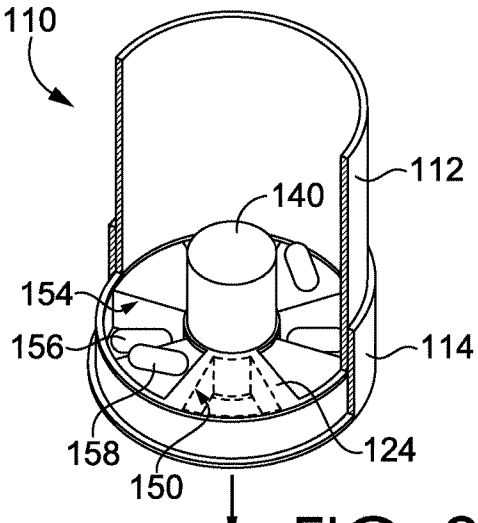
FIG. 9C depicts a detail perspective view of a medication dispensing apparatus having the dispensing cap of FIG. 8 in the second position dispensing a medication, in accordance with aspects hereof.
Figure 9B:
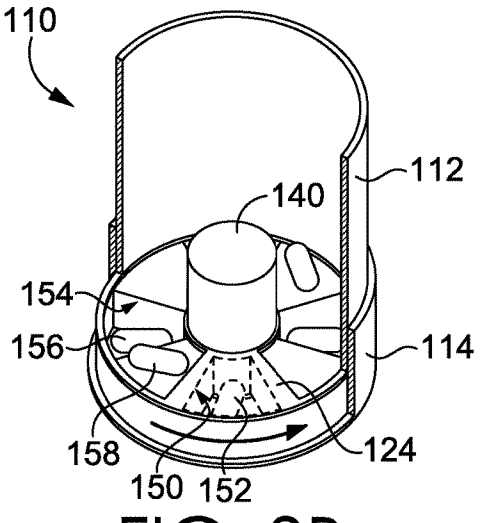
FIG. 9B depicts a detail perspective view of a medication dispensing apparatus having the dispensing cap of FIG. 8 in a second position, in accordance with aspects hereof.
Figure 9A:
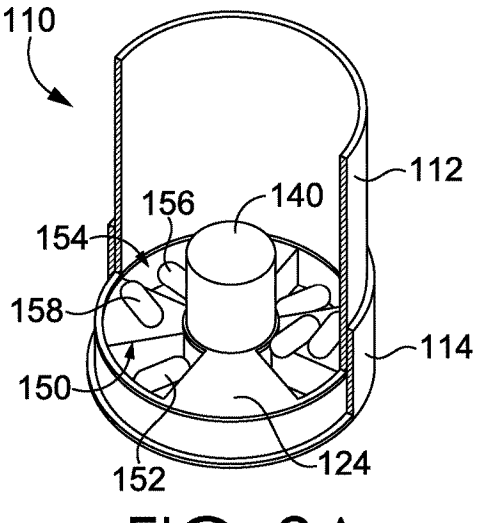
FIG. 9A depicts a detail perspective view of a medication dispensing apparatus having the dispensing cap of FIG. 8 in a first position, in accordance with aspects hereof.
Figure 9E:
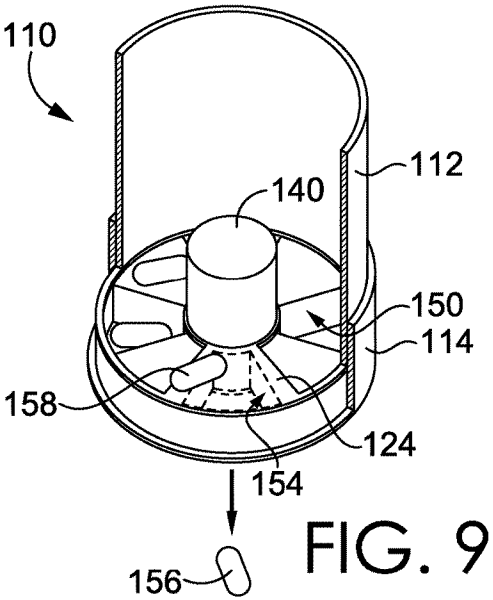
FIG. 9E depicts a detail perspective view of a medication dispensing apparatus having the dispensing cap of FIG. 8 in the third position dispensing a medication, in accordance with aspects hereof.
Figure 9D:
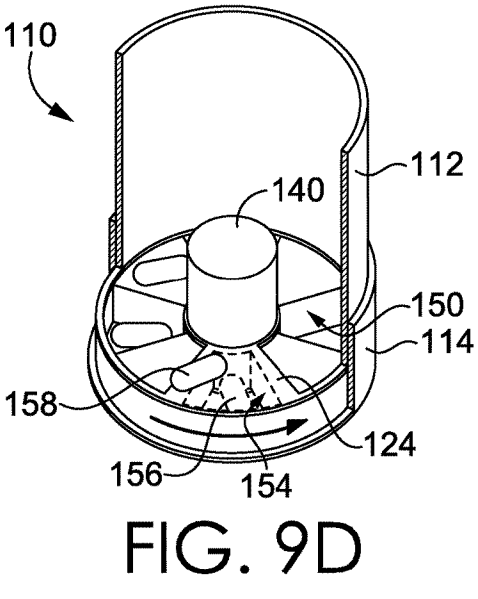
FIG. 9D depicts a detail perspective view of a medication dispensing apparatus having the dispensing cap of FIG. 8 in a third position, in accordance with aspects hereof.

FIG. 9A shows the medication dispensing apparatus 110 prior to dispensing medication. Upon reaching a first time to administer the medication, the motor 140 turns the dispensing disc 128 to the position shown in FIG. 9B. In this position, the first cavity 150 is aligned with the dispensing port 123 and the first pill 152 is dispensed, as shown in FIG. 9C. Upon reaching a second time to administer the medication, the motor 140 turns the dispensing disc 128 to the position shown in FIG. 9D. In this position, the second cavity 154 is aligned with the dispensing port 123 and the second pill 156 is dispensed, as shown in FIG. 9E. In this aspect, the screen 124 performs a scraping function. A third pill 158 is resting on a portion of the dispensing disc 128 between the first cavity 150 and the second cavity 154. As the dispensing disc 128 is rotated between the positions shown in FIGS. 9B and 9C to the positions shown in FIGS. 9D and 9E, the third pill 158 is not pushed into the second cavity 154 but instead passes over the first surface 127 of the screen 124.

Figure 11:
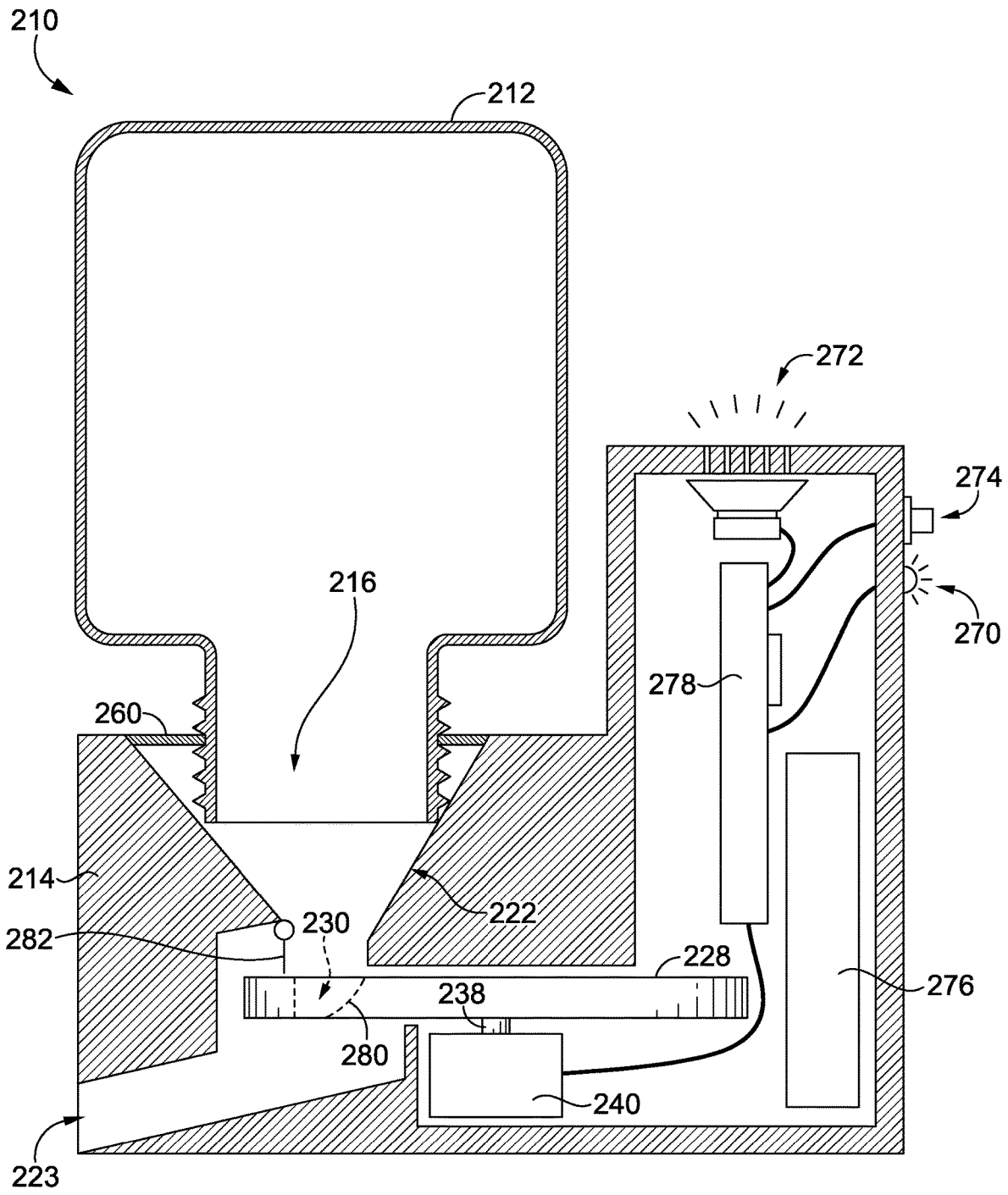
FIG. 11 depicts an elevation view another aspect of a medication dispensing apparatus, in accordance with aspects hereof.

Turning now to FIG. 11, another aspect of a medication dispensing apparatus 210 is illustrated. The medication dispensing apparatus 210 includes a medication container 212 releasably coupled to a dispensing cap 214. The dispensing cap may include an input port 222 having a variable width to accommodate various dimensioned medication containers 212, such that the medication can flow from the medication container 212 to the dispensing cap 214 in a direction 216. The dispensing cap 214 may include an adjustable bottle fastener 260 through which the medication container is releasably coupled to the dispensing cap 214. The dispensing cap 214 may operate substantially as described above and include substantially the same features as those described above (e.g., a dispensing disc 228 having one or more cavities 230 and coupled to an output shaft 238 of a motor 240 that controls communication of the medication through the dispensing cap 214 and out through a dispensing port 223). At least one of the one or more cavities 230 may have an angled wall portion 280. The angled wall portion 280 may be curved, sloped, or slanted such that a top of the cavity 230 has a greater area than a bottom of the cavity 230. This allows one pill to fall through the cavity 230 and slide down the angled wall portion 280, preventing more than one pill from simultaneously entering the cavity 230.

Some aspects may also include a brush 260 that scrapes excess medication away from the one or more cavities 230 in the dispensing disc 228. Furthermore, some aspects may include a sweeper 282 configured to prevent medication or any other items from sliding through a space between an outer circumference of the dispensing disc 228 and an inner wall of the dispensing cap 214, such that only the prescribed dose of medication exits the dispensing port 223.

The dispensing cap 214 may also include a notification device such as a visual indicator (e.g., a LED, a light, etc.) 270 and/or an audible indicator 272 (e.g., a speaker), and may further include an input source 274 (e.g., one or more buttons), a power supply 276 (e.g., a battery), and a control unit 278. The control unit 278 may be configured to control power supplied to the visual indicator 270 (e.g., to control light emitted therefrom), to the audible indicator 272 (e.g., to control sound emitted therefrom), and to the motor 240 (e.g., to control rotation of features coupled to the output shaft 238, such as the dispensing disc 228).

Figure 12:
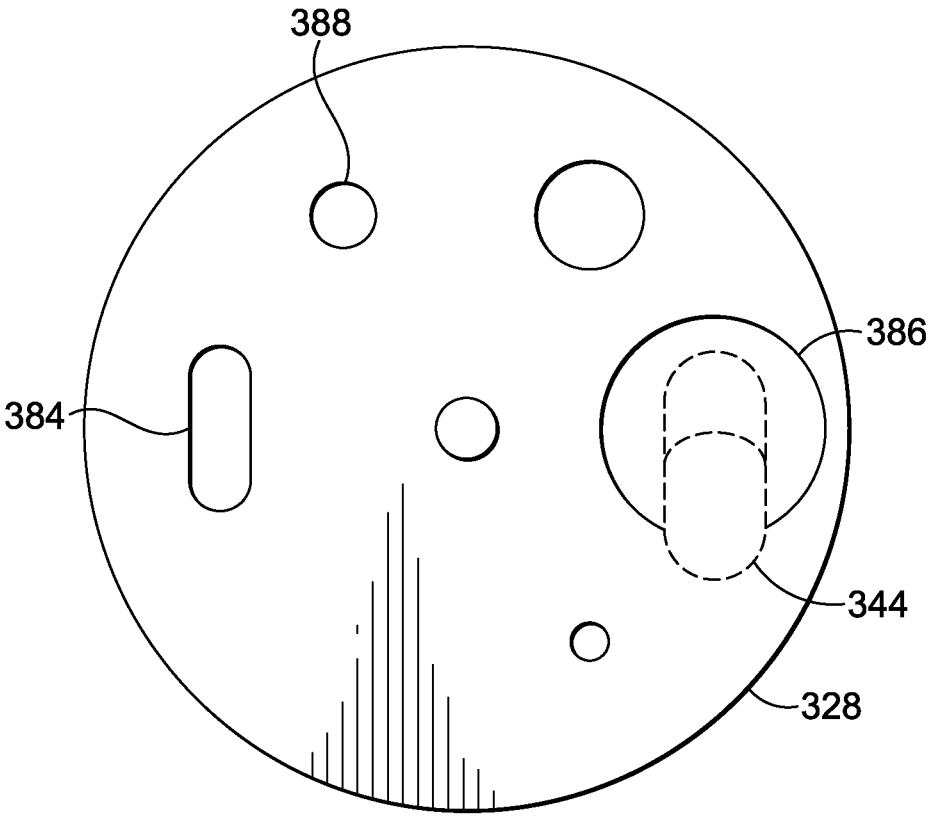
FIG. 12 depicts a top plan view of a dispensing cap for a medication dispensing apparatus, in accordance with aspects hereof.

As illustrated in FIG. 12, another aspect of a dispensing disc 328 includes one or more cavities of different shapes and sizes (e.g., an oblong shape 384 and circular shapes 386, 388 of varying sizes). This allows for different numbers of pills 344 to fit through these various cavities, as well as dosage control of various sizes and shapes of the pills 344.

In application, the microcontroller described herein may be loaded to control the motor to dispense medications based on received instructions. The instructions may include a dosage, frequency, route of administration, medication identifier, etc. The instructions may be communicated to the microcontroller to control the mechanisms of the dispensing cap to dispense an appropriate dosage of a medication at an appropriate time.

In embodiments, a medication is prescribed to a patient. The medication is typically prescribed by a clinician and then sent to (or dropped off at) a pharmacy or other medication dispensing facility. With the prescription are orders from the clinician on how to take the medication. The order include a medication identifier (e.g., a name of a medication, a generic name of a medication, any other identifier linked to a medication), a dosage (e.g., 500 mg), a frequency (e.g., two times daily), and a route of administration (e.g., orally). In embodiments, the order (or prescription) is input into a patient's electronic health record (EHR) and may then be directed routed to a pharmacy for fulfillment.

Upon receiving the order at the pharmacy, a pharmacist, or any authorized provider, may review the order. A dispensing cap that corresponds to a medication container associated with the medication identifier is identified. As previously described, dispensing caps may come in various sizes. The system (e.g., the pharmacy system receiving the order) may automatically identify a dispensing cap size that corresponds to the medication container for the medication prescribed. Each dispensing cap may be associated with a unique cap identifier. Said cap identifier may be what is provided by the system when identifying appropriate dispensing caps. Once the appropriate dispensing cap is identified, whether by the system or a clinician, the cap identifier may be linked to the order. Once linked, the instructions are available for download by the dispensing cap (i.e., the microcontroller of the dispensing cap) from a server. The dispensing cap may communicate with the server utilizing Wi-Fi or any other known communication means to download the instructions.

This configuration may also be utilized with over-the-counter medications. A customer, for example, may provide an over-the-counter medication to a clinician and request a dispensing cap. Using the above described linking method, an appropriate dispensing cap identifier would be linked to the over-the-counter medication and customized dosage instructions. The customized instructions may be input by the clinician. Alternatively, dispensing caps may be configurable by non-clinician users for particular medications. For instance, dispensing caps may be universally configurable for daily allergy medications but never configurable for a narcotic that should have been obtained via a prescription. The server, from which the dispensing cap communicates and downloads instructions, may include data regarding approved medications and denied medications for which the cap may be configured. Medications may be associated with various access levels for configuration with a dispensing cap.

An interface may be provided to users (clinicians and non-clinicians) to link instructions to dispensing caps. In the case of clinicians, the interface may be directly in the EHR (e.g., while entering the order) or in the pharmacy system (e.g., while fulfilling the order). In the case of non-clinician users, the interface may be provided in a web-based application.

Once the order is linked to the dispensing cap's identifier, the microcontroller retrieves, receives, or the like, the instructions from a server. The microcontroller may automatically receive the instructions based on an activation within, for instance, the interface where the dispensing cap was linked with the order. The microcontroller may receive the instructions based on a manual input on the dispensing cap itself. For instance, a user may press the input button on dispensing cap to activate the cap and initiate retrieval/receiving of instructions.

The microcontroller may parse the instructions to identify a frequency and dosage, which may be tagged in the instructions as such. Alternatively, the microcontroller may be configured to identify other identifiers associated with frequency and dosage, such as quantitative words or abbreviations (e.g., milligrams, mg, two times, etc.) or time intervals (e.g., daily, etc.). Once activated, the microcontroller may activate a timer such that the frequency is maintained appropriately (e.g., two times a day may result in a timer that is at least 8 hours between doses, three times a day may result in a timer that runs at four hour intervals, etc.). By way of example, once activated, it is typical for a user to immediately take a first dose and, thus, a timer would then begin until the next dose. Various timing configurations are available and may be programmed into the instructions.

Upon expiration of the programmed time interval, the dispensing cap may alert a user that it is time for the next dose of their medication. The notification, as previously described, may be an audible alert (e.g., beep), a visual alert (e.g., flashing light), a combination thereof, or the like from the notification device. Additionally, the intensity of the alerts/notifications may change as time elapses. For instance, if a user is 5 minutes past due on their medication dose, the indicators may speed up or get louder. If a patient is 3 hours overdue, the indicators may be going even faster and louder. In embodiments, both indicators may alert at once when a user is a predetermined period of time past the scheduled dose. An alerting threshold (a predetermined maximum period of time to let a user miss a dose before escalating the missed dose) may be set such that the missed dose is escalated to a clinician, pharmacist, other healthcare provider, family member, or the like. The notifications and thresholds may be configurable and optional, and may be communicated via any type of cellular communication used to send alerts (e.g., text messages).

When a dispensing cap alerts a user that it is time for a dose of medication, a user may initiate, or the dispensing cap may automatically initiate, the dispensing of the medication. Whether manual (by pressing a button) or automatic (by an indication in the instructions to the microcontroller), the microcontroller initiates dispensing by controlling the motor, which, in turn, turns the dispensing disc to align a cavity of the dispensing disc with a dispensing port, as discussed herein. The microcontroller, and the instructions thereon, control activation and movement of the motor and, thus, the components within the dispensing cap.

In embodiments, prior to initiating the dispensing of the medication, the dispensing cap may verify the dispensing. In the instance where an alert is provided that it is time for a dose, the microcontroller has already verified the dispensing. In the instance where the microcontroller has not yet notified a user that it is time for a dose but has received a manual indication to initiate the dispensing, the microcontroller may verify dosing instructions. This verification may include comparing the time elapsed since the last dispensed dose and the dosing instructions in the configuration instructions. If the time elapsed is greater than a predetermined threshold, the microcontroller may dispense the medication and reset the timer to the next dose. If the time elapsed is less than a predetermined threshold, the microcontroller may not dispense the medication. The microcontroller may, in that instance, send a notification to a clinician to seek approval to dispense the medication early. If approved, the microcontroller may proceed with dispensing. If not approved, the microcontroller may not dispense. Additionally, a reason for the denial of dispensing may be provided to the user via the web-based application.

The microcontroller may also intelligently identify refill information by identifying a quantity of medication that was originally provided (via the instructions) and how much time has passed (e.g., a medication was prescribed with a 30 day supply and the user filled it 20 days ago) or how much medication has been dispensed (e.g., a medication was prescribed with a 30 day supply and was filled 20 days ago, but only 10 days have been dispensed). The microcontroller can prompt a notification (audible or visual) to alert a user that a refill is coming up or is due. Refill alerts may also be communicated to the prescribing clinician and/or the pharmacy.

The microcontroller may update a data log with status updates such as dispense times, dispense requests that were not prompted by an alert, etc. This data log may be viewed by the clinician, pharmacist, user, family member (if approved by the user), etc. The information may be viewed via the user interface described herein.

An exemplary operating environment is described herein for practicing an embodiment of this disclosure. As described above, some embodiments may be implemented as a system, comprising one or more computers and associated network and equipment, upon which a method or computer software application is executed. Accordingly, aspects of the present disclosure may take the form of an embodiment combining software and hardware aspects that may all generally be referred to herein as a "module" or "system." Further, the methods of the present disclosure may take the form of a computer application embodied in computer readable media having machine-readable application software embodied thereon. In this regard, a machine-readable storage media may be any tangible medium that can contain, or store a software application for use by the computing apparatus.

Computer application software for carrying out operations for system components or steps of the methods of the present disclosure may be authored in any combination of one or more programming languages, including an object-oriented programming language such as Java, Python, R, or C++ or the like. Alternatively, the application software may be authored in any or a combination of traditional non-object-oriented languages, such as C or Fortran. The application may execute entirely on the user's computer as an independent software package, or partly on the user's computer in concert with other connected co-located computers or servers, or partly on the user's computer and partly on one or more remote computers, or entirely on a remote computer or collection of computers. In the latter cases, the remote computers may be connected to the user's computer through any type of network, including a local area network (LAN) or a wide area network (WAN), or the connection may be made to an external computer (for example, via the internet using an Internet Service Provider or ISP) or an arbitrary, geographically-distributed, federated system of computers, such as a cloud-based system.

An exemplary environment may comprise the Internet, and/or one or more public networks, private networks, other communications networks, such as a cellular network or similar network(s) for facilitating communication among devices connected through the network. In some embodiments, a network may be determined based on factors such as the source and destination of the information communicated over the network, the path between the source and destination, or the nature of the information. For example, intra-organization or internal communication may use a private network or virtual private network (VPN).

Examplary operating environments further include a user/clinician interface an an application for use with medication dispensing caps. It is contemplated that an embodiment of the interface and/or application may be communicatively coupled to an EHR system directly or indirectly. An embodiment of the application comprises a software application or set of applications (which may include programs, routines, functions, or computer-performed services) residing on a client computing device, such as a personal computer, laptop, smartphone, tablet, or mobile computing device or the application may reside on a remote server communicatively coupled to a client computing device. In an embodiment, the application is a Web-based application or applet and may be used to provide or manage user services provided by an embodiment of the technologies described herein. In some embodiments the application utilizes the user/clinician interface.

Figure 13:
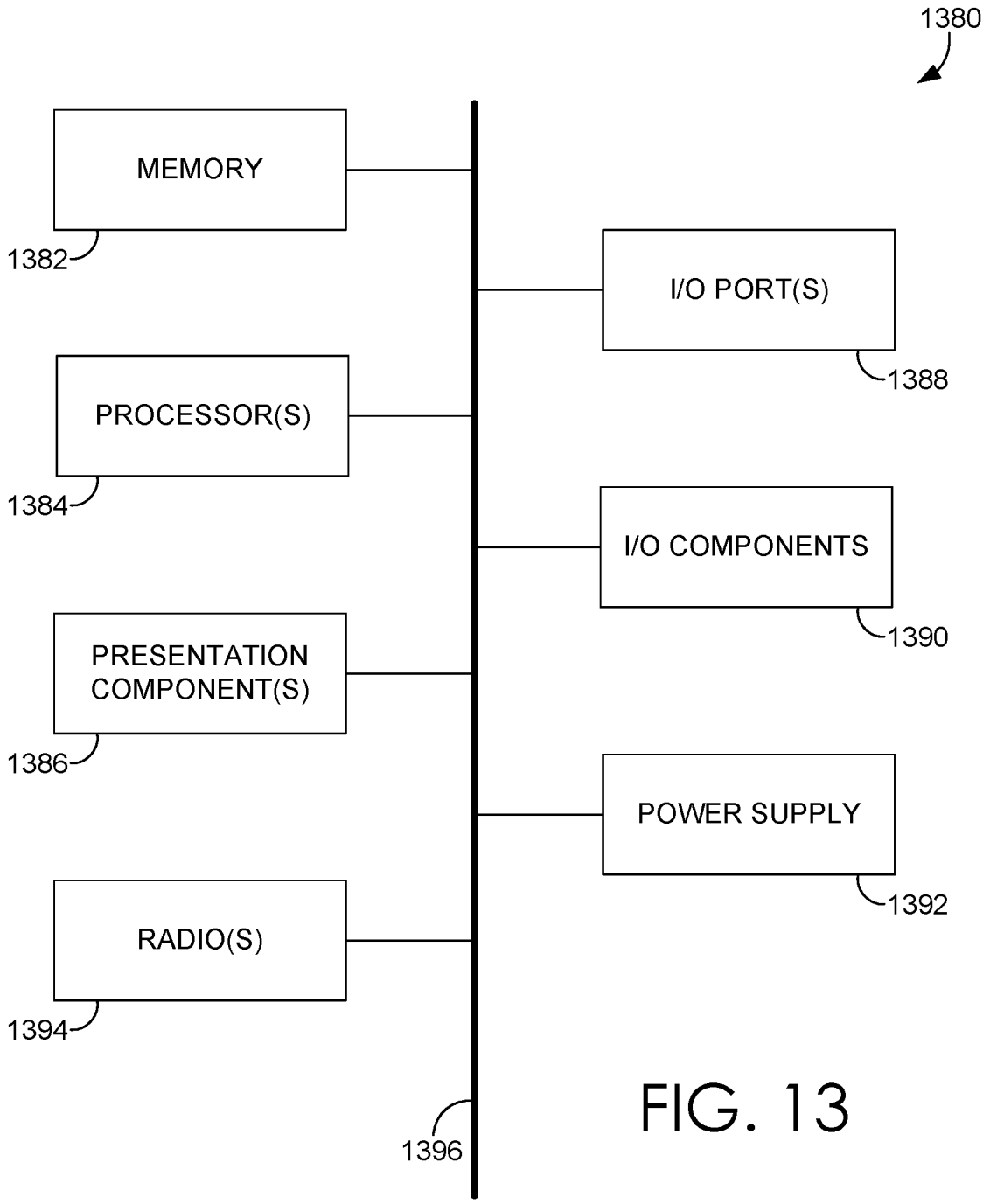
FIG. 13 depicts aspects of an illustrative operating environment suitable for practicing an embodiment of the disclosure.

Turning now to FIG. 13, there is shown one example embodiment of a computing system representative of a system architecture that is suitable for the present disclosure. Computing device 1380 includes a bus 1396 that directly or indirectly couples to the following devices: memory 1382, one or more processors 1384, one or more presentation components 1386, input/output (I/O) ports 1388, input/output components 1390, radio 1394, and an illustrative power supply 1392. Bus 196 represents what may be one or more busses (such as an address bus, data bus, or combination thereof). Although the various blocks of FIG. 13 are shown with lines for the sake of clarity, in reality, delineating various components is not so clear, and metaphorically, the lines would more accurately be grey and fuzzy. For example, one may consider a presentation component, such as a display device, to be an I/O component. Also, processors have memory. As such, the diagram of FIG. 13 is merely illustrative of an exemplary computing system that can be used in connection with one or more embodiments of the present invention. Distinction is not made between such categories as "workstation," "server," "laptop," "hand-held device," etc., as all are contemplated within the scope of FIG. 13 and reference to "computing system."

Computing system 1380 typically includes a variety of computer-readable media. Computer-readable media can be any available media that can be accessed by computing system 180 and includes both volatile and nonvolatile media, and removable and non-removable media. By way of example, and not limitation, computer-readable media may comprise computer storage media and communication media. Computer storage media includes both volatile and nonvolatile, removable and non-removable media implemented in any method or technology for storage of information such as computer-readable instructions, data structures, program modules or other data. Computer storage media includes, but is not limited to, RAM, ROM, EEPROM, flash memory or other memory technology, CD-ROM, digital versatile discs (DVD) or other optical disc storage, magnetic cassettes, magnetic tape, magnetic disc storage or other magnetic storage devices, or any other medium which can be used to store the desired information and which can be accessed by computing system 1380. Computer storage media does not comprise signals per se. Communication media typically embodies computer-readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above should also be included within the scope of computer-readable media.

Memory 1382 includes computer-storage media in the form of volatile and/or nonvolatile memory. The memory may be removable, non-removable, or a combination thereof. Exemplary hardware devices include solid-state memory, hard drives, optical-disc drives, etc. Computing system 1380 includes one or more processors that read data from various entities such as memory 1382 or I/O components 1390. Presentation component(s) 1386 present data indications to a user or other device. Exemplary presentation components include a display device, speaker, printing component, vibrating component, etc.

In some embodiments, computing system 1380 comprises radio(s) 1394 that facilitates communication with a wireless-telecommunications network. Illustrative wireless telecommunications technologies include CDMA, GPRS, TDMA, GSM, and the like. Radio 1394 may additionally or alternatively facilitate other types of wireless communications including Wi-Fi, WiMAX, LTE, or other VoIP communications. As can be appreciated, in various embodiments, radio 1394 can be configured to support multiple technologies and/or multiple radios can be utilized to support multiple technologies.

I/O ports 1388 allow computing system 1380 to be logically coupled to other devices, including I/O components 1390, some of which may be built in. Illustrative components include a microphone, joystick, game pad, satellite dish, scanner, printer, wireless device, etc. The I/O components 1390 may provide a natural user interface (NUI) that processes air gestures, voice, or other physiological inputs generated by a user. In some instances, inputs may be transmitted to an appropriate network element for further processing. An NUI may implement any combination of speech recognition, stylus recognition, facial recognition, biometric recognition, gesture recognition both on screen and adjacent to the screen, air gestures, head and eye tracking, and touch recognition (as described in more detail below) associated with a display of the computing system 1380. The computing system 1380 may be equipped with depth cameras, such as stereoscopic camera systems, infrared camera systems, RGB camera systems, touchscreen technology, and combinations of these, for gesture detection and recognition. Additionally, the computing system 1380 may be equipped with accelerometers or gyroscopes that enable detection of motion.

The architecture depicted in FIG. 13 is provided as one example of any number of suitable computer architectures, such as computing architectures that support local, distributed, or cloud-based software platforms.

Additionally, although some exemplary implementations of the embodiments described herein are shown in the accompanying figures, these implementations are not intended to be limiting. Rather, it should be understood that the various embodiments and aspects described herein may be implemented upon any mower having a cutting deck and a discharge opening therein.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described. Accordingly, the scope of the invention is intended to be limited only by the claims.

What is claimed:

1. A medication dispensing apparatus comprising:

a dispensing cap comprising:

a variable width input port configured to accommodate various dimensioned medication containers and for receiving a medication from a coupled medication container of the various dimensioned medication containers;

a dispensing port for dispensing the medication received;

a dispensing disc positioned between the variable width input port and the dispensing port, having a first surface opposite a second surface and a first cavity extending through the dispensing disc from the first surface to the second surface, the dispensing disc for receiving the medication in the first cavity from the variable width input port and for dispensing the medication from the first cavity to the dispensing port;

a motor coupled to the dispensing disc through an output shaft and configured for turning the dispensing disc to position the first cavity relative to the variable width input port to receive the medication and to position the first cavity relative to the dispensing port to dispense the medication; and a microcontroller coupled to the motor.

2. The medication dispensing apparatus of claim 1, a second cavity extending through the dispensing disc from the first surface to the second surface, wherein the first cavity has a different size than the second cavity.

3. The medication dispensing apparatus of claim 1, further comprising a second cavity extending through the dispensing disc from the first surface to the second surface, wherein the first cavity has a different shape than the second cavity.

4. The medication dispensing apparatus of claim 1, wherein the motor is at least one of:

manually actuatable, and actuatable via instructions provided to the microcontroller; and wherein the motor is configured to turn the dispensing disc between a first rotational orientation and a second rotational orientation, wherein the partition covers the first cavity when the dispensing disc is in the first rotational orientation and the partition port vertically aligns with the first cavity when the dispensing disc is in the second rotational orientation.

5. The medication dispensing apparatus of claim 1, further comprising the coupled medication container, such that the variable width input port receives the medication from the coupled medication container.

6. The medication dispensing apparatus of claim 5, wherein the microcontroller is configured to identify refill information based on a quantity of medication that was originally provided to the coupled medication container and how much time has passed or how much of the medication has been dispensed and to output a notification to a user, prescribing clinician, or pharmacy that a refill is coming up or is due.

7. The medication dispensing apparatus of claim 1, wherein the microcontroller comprises or is communicably coupled with a timer, wherein the microcontroller is configured to set the timer for prescribed intervals of time.

8. The medication dispensing apparatus of claim 7, wherein the microcontroller is configured to activate the motor to turn the dispensing disc to release a prescribed quantity of the medication at the prescribed intervals of time, as indicated by the timer.

9. The medication dispensing apparatus of claim 7, further comprising a notification device, wherein the microcontroller communicates with the notification device configured to output an alert to a user that it is time for a next dose of medication at the prescribed intervals of time, as indicated by the timer.

10. The medication dispensing apparatus of claim 9, wherein the microcontroller is communicably coupled with a data log, wherein the microcontroller is configured to update the data log with status updates including at least one of dispense times and dispense requests that were not prompted by the alert.

11. A medication dispensing apparatus comprising:

a medication container;

a dispensing cap coupled to the medication container, the dispensing cap comprising:

a variable width input port configured to accommodate various dimensioned medication containers and for receiving medication from the medication container;

a dispensing port for dispensing the medication received by the variable width input port;

a dispensing disc positioned between the variable width input port and the dispensing t port, the dispensing disc having a first surface opposite a second surface and a first cavity extending through the dispensing disc from the first surface to the second surface, the dispensing disc for receiving the medication in the first cavity from the variable width input port and for dispensing the medication from the first cavity to the dispensing port;

a motor coupled to the dispensing disc and configured for rotating the dispensing disc to align at least a portion of the first cavity with the variable width input port to receive the medication or with the dispensing port to dispense the medication; and a microcontroller coupled to the motor, wherein the motor is at least one of manually actuatable and actuatable via instructions provided to the microcontroller.

12. The medication dispensing apparatus of claim 11, wherein the microcontroller is configured to identify refill information based on a quantity of the medication that was originally provided in the medication container and how much time has passed or how much of the medication has been dispensed and to output a notification to a user, prescribing clinician, or pharmacy that a refill is coming up or is due.

13. The medication dispensing apparatus of claim 11, wherein the medication container has a domed top opposite the dispensing cap.

14. The medication dispensing apparatus of claim 11, further comprising a second cavity extending through the dispensing disc from the first surface to the second surface, wherein the first cavity has at least one of a different size than the second cavity and a different shape than the second cavity.

15. The medication dispensing apparatus of claim 11, wherein the microcontroller comprises or is communicably coupled with a timer, wherein the microcontroller is configured to set the timer for prescribed intervals of time and to activate the motor to rotate the dispensing disc to release a prescribed quantity of the medication from within the medication container at the prescribed intervals of time.

16. The medication dispensing apparatus of claim 15, further comprising a notification device, wherein the microcontroller communicates with the notification device to output an alert to a user that it is time for a next dose medication at the prescribed intervals of time.

17. The medication dispensing apparatus of claim 16, wherein the microcontroller is communicably coupled with a data log, wherein the microcontroller is configured to update the data log with status updates including at least one of dispense times and dispense requests that were not prompted by the alert.

18. A medication dispensing apparatus comprising:

a medication container;

a dispensing cap coupled to the medication container, the dispensing cap comprising:

an adjustable bottle fastener;

a variable width input port for receiving medication from the medication container;

a dispensing port for dispensing the medication;

a dispensing disc positioned between the variable width input port and the dispensing port, the dispensing disc having a first surface opposite a second surface and a first cavity extending through the dispensing disc from the first surface to the second surface, the dispensing disc for receiving the medication in the first cavity from the variable width input port and for dispensing the medication from the first cavity to the dispensing port;

a motor coupled to the dispensing disc and configured for rotating the dispensing disc to align at least a portion of the first cavity with the variable width input port to receive the medication or with the dispensing port to dispense the medication;

a notification device; and a microcontroller electrically coupled to the motor and the notification device, the microcontroller comprising or communicatively coupled with a timer and a data log, wherein the motor is at least one of manually actuatable and actuatable via instructions provided to the microcontroller, wherein the microcontroller contains executable instructions to perform the following:

set the timer for prescribed intervals of time and to activate the motor to rotate the dispensing disc to release a prescribed quantity of the medication from within the medication container at the prescribed intervals of time, instruct the notification device to output an alert to a user that it is time for a next dose medication at the prescribed intervals of time, update the data log with status updates including at least one of dispense times and dispense requests that were not prompted by the alert, and identify refill information based on a quantity of the medication that was originally provided in the medication container and how much time has passed or how much of the medication has been dispensed and to output a notification to the user, prescribing clinician, or pharmacy that a refill is coming up or is due.

19. The medication dispensing apparatus of claim 18, further comprising a second cavity extending through the dispensing disc from the first surface to the second surface, wherein the first cavity has at least one of a different size than the second cavity and a different shape than the second cavity.

20. The medication dispensing apparatus of claim 18, wherein the medication container has a domed top opposite the dispensing cap.

* * * * *